US008435360B2

(12) United States Patent
Dingwerth et al.

(10) Patent No.: US 8,435,360 B2
(45) Date of Patent: May 7, 2013

(54) ANTI-CORROSION TREATMENT FOR CONVERSION LAYERS

(75) Inventors: Björn Dingwerth, Berlin (DE); Andreas Noack, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 397 days.

(21) Appl. No.: 12/664,002

(22) PCT Filed: Jun. 13, 2008

(86) PCT No.: PCT/EP2008/004793

§ 371 (c)(1),
(2), (4) Date: Dec. 10, 2009

(87) PCT Pub. No.: WO2008/151829

PCT Pub. Date: Dec. 18, 2008

(65) Prior Publication Data

US 2010/0180793 A1 Jul. 22, 2010

(30) Foreign Application Priority Data

Jun. 14, 2007 (EP) ..... 07011720

(51) Int. Cl.
*C23C 22/30* (2006.01)

(52) U.S. Cl.
USPC ..... 148/267; 148/264

(58) Field of Classification Search ..... 148/264–268
See application file for complete search history.

(56) References Cited

U.S. PATENT DOCUMENTS

| | | | | |
|---|---|---|---|---|
| 4,671,825 | A * | 6/1987 | Ishii et al. | 148/251 |
| 2007/0017602 | A1 | 1/2007 | Koch et al. | |
| 2007/0243397 | A1 * | 10/2007 | Ludwig et al. | 428/472.1 |
| 2009/0020185 | A1 * | 1/2009 | Inoue | 148/250 |

FOREIGN PATENT DOCUMENTS

| | | | |
|---|---|---|---|
| CA | 2 312 807 | A1 | 6/1999 |
| CA | 2 362 556 | A1 | 8/2000 |
| CN | 1890404 | A | 1/2007 |
| DE | 196 38 176 | A1 | 4/1998 |
| DE | 197 54 108 | A1 | 6/1999 |
| DE | 10 2005 025 830 | A1 | 12/2006 |
| JP | 55-031114 | A | 3/1980 |
| JP | 2003-293156 | A | 10/2003 |
| JP | 2005-23372 | A | 1/2005 |
| JP | 2005126796 | A | 5/2005 |
| WO | 92/06225 | A1 | 4/1992 |
| WO | 00/47799 | A1 | 8/2000 |
| WO | 02/07902 | A2 | 1/2002 |
| WO | WO 2007/100135 | * | 9/2007 |

OTHER PUBLICATIONS

Database WPI Week 200511, Thomson Scientific London, GB; AN 2005-096020, XP 002483258 & JP 2005-23372 A.
English Abstract for DE 10 2005 025 830, "Simultaneous passivation and black coloration of substrate coated with zinc-nickel alloy, using acidic solution containing weakly coordinating anion", Dec. 7, 2006.
English Abstract for DE 196 38 176, "Corrosion resistant hexavalent chromium-free chromate coating", Apr. 16, 1998.

* cited by examiner

*Primary Examiner* — Lois Zheng
(74) *Attorney, Agent, or Firm* — Edwards Wildman Palmer LLP; Peter F. Corless; Christine C. O'Day

(57) ABSTRACT

The invention relates to a method for producing a coating layer protecting against corrosion wherein a surface which is to be treated is brought into contact with an aqueous treatment solution containing chromium(III) ions and at least one phosphate compound, wherein the ratio of the molar concentration of the chromium(III) ions to the molar concentration of the at least one phosphate compound (calculated as orthophosphate) lies between 1:1.5 and 1:3. The method improves the corrosion protection of metallic, in particular, zinc-containing, surfaces provided with conversion layers. The decorative and functional properties of the surface are maintained or improved. Furthermore, the known problems resulting from the use of chromium(VI)-containing compounds or from post-treatments with polymer dispersions are avoided.

18 Claims, No Drawings

ANTI-CORROSION TREATMENT FOR CONVERSION LAYERS

FIELD OF THE INVENTION

The invention relates to the protection against corrosion of metallic materials, in particular, materials provided with a conversion layer.

BACKGROUND OF THE INVENTION

There are several methods known in the prior art for protecting metallic material surfaces against corrosive environmental influences. The coating of a metallic work piece that is to be protected with a coating of another metal is a commonly used and well established method of the prior art. In the corrosive medium, the coating metal can be electrochemically more or less noble than the material base metal. If the coating metal is less noble, it functions, in the corrosive medium, as a sacrificial anode relative to the base metal (cathodic corrosion protection). Although the protective function resulting from the formation of corrosion products of the coating metal is desired, the corrosion products of the coating often result in undesirable decorative and not in frequently functional deterioration of the work piece. In order to reduce or prevent, for as long as possible, the corrosion of the coating metal, so-called conversion layers are frequently used, especially on cathodically protecting less noble coating metals such as zinc or aluminum and their alloys. These conversion layers are reaction products of the less noble coating metal with the treatment solution, which reaction products are insoluble in aqueous media over a broad pH range. Examples for these so-called conversion layers are so-called phosphatizations and chomatizations.

In the case of phosphatizations, the layer which is to be protected is immersed into an acidic solution containing phosphate ions (see, for example, WO 00/47799). The acidic medium results in the partial dissolution of zinc from the coating. The $Zn^{2+}$ cations thus released, together with the phosphate ions of the treatment solution form a poorly soluble zinc phosphate layer on the surface. Since zinc phosphate layers themselves only provide comparatively poor protection against corrosion, but an excellent adherent surface for varnishes and paints applied thereto, their main area of application lies in their function as base layers for the application of varnishes and paints.

In the case of chromatizations, the surface to be treated is immersed into an acidic solution-containing chromium(VI) ions (see EP 0 553 164 A1). In the case of, for example, a zinc surface, a part of the zinc dissolves. Under the reductive conditions which then prevail, chromium(VI) is reduced to chromium(III) which is precipitated in the surface film rendered more alkaline through the evolution of hydrogen inter alia as chromium(III) hydroxide or as poorly soluble μ-oxo- or μ-hydroxo-bridged chromium(III) complex. In parallel, poorly soluble zinc chromate(VI) is formed. As a result, there is formed a tightly closed conversion layer on the zinc surface which provides good protection against corrosive attack by electrolytes.

However, chromium(VI) compounds are acutely toxic and strongly carcinogenic so that a replacement for processes using these compounds has to be found.

As a replacement for chromatization processes using hexavalent chromium compounds, there have now been established a number of processes using various complexes of trivalent chromium compounds (see DE 196 38 176 A1). Since the protection against corrosion that may be achieved thereby is usually inferior to that achieved with processes using hexavalent chromium, an additional organic sealing layer is often applied to work piece surfaces, usually by deposition from aqueous polymer dispersions. Especially when using so-called black passivations, i.e. processes in which black layers are formed on zinc-containing surfaces by means of trivalent chromium compounds, the post treatment of this first conversion layer for improving the protection against corrosion is indispensible according to the prior art (see WO 02/07902 A2). A disadvantage of this additional process step using polymer dispersions is the formation of drain lines with work pieces coated on a rack and/or the sticking together of pieces coated in bulk. Furthermore, there are problems regarding the size accuracy of threads and the like resulting from the thickness of such organic sealings. If such sealings provide strong protection against corrosion, the adhesion to the coated surface is normally also very strong. This means that adhesion to parts of the coating apparatus is also very good, which renders their cleaning difficult. Moreover, any items with coating faults which are to be recycled through the entire coating process must be de-coated with considerable effort, which usually requires an additional process step.

Moreover, it is difficult to achieve friction coefficients $\mu_{tot.}>0.25$ (DIN 946) for surfaces obtained by treatment with known polymer dispersions whose properties are determined mainly by the characteristics of the dispersed polymer.

DESCRIPTION OF THE INVENTION

It is the object of the invention to provide methods for improving the protection against corrosion of metallic, in particular, zinc-containing, surfaces provided with conversion layers. At the same time, the decorative and functional properties of the surfaces are maintained or improved. Furthermore, the aforementioned problems resulting from the use of chromium(VI)-containing compounds or from post-treatments with polymer dispersions are avoided.

In order to achieve this object, the invention provides a method for producing a coating protecting against corrosion wherein the surface which is to be treated is brought into contact with an aqueous treatment solution containing chromium(III) ions and at least one phosphate compound, wherein the ratio of the molar concentration (i.e. the concentration in mol/l) of chromium(III) ions to the molar concentration of the at least one phosphate compound (calculated as orthophosphate) ([chromium(III)-ions]:[phosphate compound]) lies between 1:1.5 and 1:3.

Phosphate compounds are oxocompounds derived from phosphorous of the oxidation state +V as well as their esters with organic residues having up to 12 carbon atoms as well as the salts of the mono and diesters. Suitable phosphate compounds are, in particular, alkyl esters of phosphoric acid with alkyl groups having up to 12 carbon atoms.

Examples of suitable phosphate compounds are orthophosphoric acid ($H_3PO_4$) and its salts, polyphosphoric acid and its salts, metaphosphoric acid and its salts, methyl phosphates (mono-, di- and triester), ethyl phosphates (mono-, di- and triester), n-propyl phosphates (mono-, di- and triester), i-propyl phosphates (mono-, di- and triester), n-butyl phosphates (mono-, di- and triester), 2-butyl phosphates (mono-, di- and triester), tert.-butyl phosphates (mono-, di- and triester), the salts of the aforementioned mono- and diesters as well as di-phosphorus pentoxide and mixtures of these compounds. The term "salts" comprises not only the salts of the fully deprotonated acids, but also salts of all possible degrees of deprotonation, for example, hydrogen phosphates and dihydrogen phosphates.

The treatment solution preferably contains between 0.2 g/l and 20 g/l of chromium(III) ions, more preferably between 0.5 g/l and 15 g/l of chromium(III) ions and most preferably between 1 g/l and 10 g/l of chromium(III) ions.

The ratio of the molar concentration of chromium(III) ions to the molar concentration of the at least one phosphate compound (calculated as orthophosphate) lies between 1:1.5 and 1:3, preferably between 1:1.7 and 1:2.5.

Chromium(III) can be added to the treatment solution either in the form of inorganic chromium(III) salts such as basic chromium(III) sulfate, chromium(III) hydroxide, chromium(III) dihydrogen phosphate, chromium(III) chloride, chromium(III) nitrate, potassium chromium(III) sulfate or chromium(III) salts of organic acids such as chromium(III) methane sulfonate, chromium(III) citrate, or it can be formed by reduction of suitable chromium(VI) compounds in the presence of suitable reducing agents. Suitable chromium(VI) compounds are, for example, chromium(VI) oxide, chromates such as potassium or sodium chromate, dichromates such as potassium or sodium dichromate. Suitable reducing agents for the in situ formation of chromium(III) ions are, for example, sulfites such as sodium sulfite, sulfur dioxide, phosphites such as sodium hypophosphite, phosphorous acid, hydrogen peroxide, methanol.

The treatment solution preferably has a pH between pH 2.5 and pH 7, preferably between pH 3 and pH 6 and particularly preferably between pH 3.5 and pH 5.

Optionally, the treatment solution can additionally contain one or more complexing agents. Suitable complexing agents are, in particular, organic chelating ligands. Examples for suitable complexing agents are polycarboxylic acids, hydroxycarboxylic acids, hydroxypolycarboxylic acids, aminocarboxylic acids or hydroxyphosphonic acids. Examples for suitable carboxylic acids are citric acid, tartaric acid, malic acid, lactic acid, gluconic acid, glucuronic acid, ascorbic acid, isocitric acid, gallic acid, glycolic acid, 3-hydroxypropionic acid, 4-hydroxybutyric acid, salicylic acid, nicotinic acid, alanine, glycine, asparagine, aspartic acid, cysteine, glutamic acid, glutamine and lysine. A suitable hydroxyphosphonic acid is, for example, Dequest 2010™ (available from Solutia Inc.); a suitable aminophosphonic acid is, for example, Dequest 2000™ (available from Solutia Inc.).

In general, in order to increase the protection against corrosion, at least one metal or metalloid such as, for example, Sc, Y, Ti, Zr, Mo, W, Mn, Fe, Co, Ni, Zn, B, Al, Si, P is added to the treatment solution. These elements can be added in the form of their salts or in the form of complex anions or the corresponding acids of these anions such as hexafluoroboric acid, hexafluorosilicic acid, hexafluorotitanic acid or hexafluorozirconic acid, tetrafluoroboric acid or hexafluorophosphoric acid or their salts.

Particularly preferably, zinc is added, which may be added in the form of zinc(II) salts such as, for example, zinc sulfate, zinc chloride, zinc phosphate, zinc oxide or zinc hydroxide. Preferably, between 0.5 g/l and 25 g/l, particularly preferably between 1 g/l and 15 g/l of $Zn^{2+}$ are added to the treatment solution. The enumeration of zinc compounds only recites examples for compounds which are suitable according to the invention; however, the group of suitable zinc compounds is not limited to the substances specifically mentioned.

Additionally (optionally), in order to improve the film formation on the surface to be treated and for increasing the hydrophobic character of the surface, the treatment solution can contain one or more water-soluble or water-dispersible polymers, selected from the group consisting of polyethylene glycols, polyvinyl pyrrolidones, polyvinyl alcohols, polyitaconic acids, polyacrylates and copolymers of the respective constituent monomers.

The concentration of the at least one polymer preferably lies in the range between 50 mg/l and 20 g/l.

The addition of the aforementioned polymers to the treatment solution results in significant improvements in the properties of the corrosion protection layers thus deposited.

Additionally (optionally), the treatment solution can contain one or more surfactant. Especially in the case of complex parts or poorly wettable surfaces, this ensures a uniform composition of the coating layer and improved drainage behavior. The use of fluoroaliphatic polymeric esters such as, for example, Fluorad FC-4432™ (available from 3M) is particularly preferable.

The surfaces treated according to the invention are metallic, preferably zinc-containing, surfaces provided with a chromium(III)-containing conversion layer.

By the method according to the invention, a layer containing chromium, phosphate(s) as well as, optionally, a metal such as zinc and optionally one or more polymeric components is deposited on the treated surface. On untreated, i.e. freshly deposited, zinc or zinc alloy surfaces not provided with a conversion layer, the method according to the invention does not result in layers significantly contributing to protection against corrosion.

In the method according to the invention, the bringing into contact of the treatment solution with the surface to be treated can be effected by methods which are known as such, in particular, by immersion.

The temperature of the treatment solution lies preferably between 10° C. and 90° C., more preferably between 20° C. and 80° C., particularly preferably between 40° C. and 60° C.

The duration of the bringing into contact lies preferably between 0.5 s and 180 s, more preferably between 5 s and 60 s, and most preferably between 10 s and 30 s.

Before carrying out the method according to the invention, the treatment solution can be produced by diluting a corresponding more concentrated solution concentrate.

The articles treated according to the invention, after bringing into contact with the treatment solution, are not rinsed, but dried.

EXAMPLES

The invention will be illustrated by the following examples.

Example 1

A treatment solution according to the invention was prepared containing the following components:

7 g/l of $Cr^{3+}$ from chromium(III) hydroxide
28 g/l of $PO_4^{3-}$ from orthophosphoric acid
9 g/l of $Zn^{2+}$ from zinc oxide
18 g/l of citric acid The pH of the solution was adjusted to 3.9 using 20% sodium hydroxide solution.

A total of 12 test pieces made of steel were coated with a 8-10 μm thick zinc layer using a weakly acidic process (Protolux 3000™ available from Atotech Deutschland GmbH) and rinsed with deionized water.

Three of the test pieces (group A; for comparison) were only dried at 70° C. for 20 min in a circulating air oven.

Another three test pieces (group B; for comparison) were immersed, without further treatment, for 20 s in a treatment solution according to the invention heated to 60° C. Then, without rinsing them, the test pieces were dried at 70° C. for 20 min in a circulating air oven.

Another three test pieces (group C; for comparison) were treated with a solution for blue passivation containing trivalent chromium ions (Corrotriblue™ available from Atotech Deutschland GmbH) in order to produce a chromium-containing conversion layer on the surface, rinsed with deionized water and dried at 70° C. for 20 min in a circulating air oven.

Another three test pieces (group D; according to the invention) were treated with a solution for blue passivation (Corrotriblue™ available from Atotech Deutschland GmbH) containing trivalent chromium ions in order to produce a chromium-containing conversion layer on the surface, rinsed with deionized water and immersed for 20 s into the treatment solution according to the invention heated to 60° C. Then, without rinsing, the test pieces were dried at 70° C. for 20 min in a circulating air oven.

The test pieces of groups A to D (three pieces each) were then tested for corrosion properties in the neutral salt-spray mist test according to DIN 50021 SS. The times until occurrence of zinc corrosion were:

group A: 3 h
group B: 3 h
group C: 24 h
group D: 72 h

Example 2

A treatment solution according to the invention having the same composition as that of Example 1 was prepared; the pH of the solution was adjusted to 3.9 using 20% sodium hydroxide solution.

A zinc-coated steel part was used as test piece having been provided with a black conversion layer by treatment with a solution for black passivation containing essentially $Cr^{3+}$, $NO_3^-$, $F^-$, and $Fe^{2+}$ (Tridur Zn H1™ available from Atotech Deutschland GmbH). After the black passivation, the thus treated test piece was rinsed and, without drying, immersed for 20 s in the treatment solution according to the invention heated to 60° C. Then, without rinsing, the test piece was dried at 60-80° C. for 5 min in a circulating air oven.

The thus treated test piece had a black, slightly iridescent surface. Drainage lines were clearly discernable. In the neutral salt-spray mist test according to DIN 50021 SS no white corrosion was observed for up to 48 h.

Examples 3 to 6

Examples 3 to 6 were carried out like Example 2; however, the composition of the treatment solution was varied as indicated in Table 1. (Moreover, the drying time for Examples 4 to 6 was 15 min.) The appearance of the surface of the test pieces and the corrosion properties (together with the data for Example 2) are also indicated in Table 1.

TABLE 1

Composition of the treatment solution and properties of the test pieces obtained in Examples 2 to 6

| | Ex. 2 | Ex. 3 | Ex. 4 | Ex. 5 | Ex. 6 |
|---|---|---|---|---|---|
| $Cr^{3+}$ (g/l) | 7 | 7 | 7 | 7 | 7 |
| $PO_3^{4-}$ (g/l) | 28 | 28 | 28 | 28 | 23 |
| $Zn^{2+}$ (g/l) | 9 | 9 | 9 | 9 | 9 |
| citric acid (g/l) | 18 | 18 | 18 | 18 | 18 |
| polyvinyl pyrrolidone [1] (g/l) | | 1 | | | |
| ionic surfactant [2] (ml/l) | | 1 | | | |
| polyvinyl alcohol [3] (g/l) | | | 1 | 1 | 1 |
| fluoro surfactant [4] (g/l) | | | | 1 | 1 |
| isopropyl phosphate [5] (g/l) | | | | | 8.5 |
| appearance | black, slightly iridescent, discernable drainage lines | homogeneous, black, not iridescent | homogeneous, black, not iridescent | homogeneous, glossy black, not iridescent | homogeneous, glossy black, not iridescent |
| corrosion | 48 h | 72 h | 120 h | 168 h | 120 h |

[1] The polyvinyl pyrrolidone used was: Sokalan HP 59 ™ available from BASF
[2] The ionic surfactant used was: Lutensit TC-APS 35 ™ available from BTC
[3] The polyvinyl alcohol used was: Mowiol 5-88 ™ available from Kuraray Specialties Europe GmbH
[4] The fluoro surfactant used was: Fluorad FC-4432 ™ available from 3M
[5] The isopropyl phosphate used was: a mixture of mono- and diester available from Merck The "appearance" is the appearance of the surface of the test piece after treatment with the treatment solution according to the invention and drying.

The "corrosion" is the duration until observation of white corrosion (<1%) in the neutral salt-spray mist test according to DIN 50021 SS.

The invention claimed is:

1. A method for producing a coating layer protecting against corrosion wherein a zinc-containing surface provided with a conversion layer is brought into contact with an aqueous treatment solution consisting essentially of chromium(III) ions, at least one phosphate compound selected from the group consisting of esters of orthophosphoric acid, polyphosphoric acids and metaphosphoric acid with organic residues having up to 12 carbon atoms as well as mixtures of these compounds, one or more complexing agents selected from the group consisting of polycarboxylic acids, hydroxycarboxylic acids, hydroxypolycarboxylic acids, aminocarboxylic acids or hydroxyphosphonic acids and aminophosphonic acids, Zinc oxide, optionally one or more water-soluble or water-dispersible polymers selected from the group consisting of polyethylene glycols, polyvinyl pyrrolidones, polyvinyl alcohols, polyitaconic acids, polyacrylates and copolymers of the respective constituent monomers; and optionally one or more metals or metalloids;

wherein the ratio of the molar concentration of the chromium(III) ions to the molar concentration of the at least one phosphate compound (calculated as orthophosphate) is between 1:1.5 and 1:3.

2. The method according to claim 1, wherein the concentration of the chromium(III) ions is between 0.2 g/l and 20 g/l.

3. The method according to claim 1, wherein the complexing agent is selected from the group consisting of citric acid, tartaric acid, malic acid, lactic acid, gluconic acid, glucuronic acid, ascorbic acid, isocitric acid, gallic acid, glycolic acid, 3-hydroxypropionic acid, 4-hydroxybutyric acid, salicylic acid, nicotinic acid, alanine, glycine, asparagine, aspartic acid, cysteine, glutamic acid, glutamine and lysine.

4. The method according to claim 1, wherein the metal or metalloid is selected from the group consisting of Sc, Y, Ti, Zr, Mo, W, Mn, Fe, Co, Ni, Zn, B, Al, Si and P.

5. The method according to claim 1, wherein the metal is zinc and the concentration of the zinc is between 0.5 g/1 and 25 g/1.

6. The method according to claim 1, wherein the metal or metalloid has been added to the treatment solution in the form of one of its salts or in the form of a complex anion or corresponding acids of said anions or their salts.

7. The method according to claim 6, wherein the acids of said anions are selected from the group consisting of hexafluoroboric acid, hexafluorosilicic acid, hexafluorotitanic acid, hexafluorozirconic acid, tetrafluoroboric acid and hexafluorophosphoric acid.

8. The method according to claim 1, wherein the pH of the treatment solution is between pH 2.5 and pH 7.

9. The method according to claim 1, wherein the pH of the treatment solution is between pH 3.5 and pH 5.

10. The method according to claim 1, wherein the pH of the treatment solution is between pH 3.8 and pH 4.5.

11. The method according to claim 1, wherein the temperature of the treatment solution is between 10° C. and 90° C.

12. The method according to claim 1, wherein the temperature of the treatment solution is between 20° C. and 80° C.

13. The method according to claim 1, wherein the temperature of the treatment solution is between 40° C. and 60° C.

14. The method according to claim 1, wherein the treatment solution has been prepared by diluting a corresponding more concentrated solution concentrate.

15. The method according to claim 1, wherein the duration of the contact is between 0.5 s and 180 s.

16. The method according to claim 1, wherein the duration of the contact is between 5 s and 60 s.

17. The method according to claim 1, wherein the duration of the contact is between 10 s and 30 s.

18. A method for producing a coating layer against corrosion, comprising contacting a zinc-containing surface provided with a conversion layer with an treatment solution, wherein the treatment solution consists essentially of chromium(III) hydroxide, an ester of orthophosphoric acid, zinc oxide, and citric acid, wherein the ratio of the molar concentration of chromium(III) ions to the molar concentration of the ester of orthophosphoric acid is between 1:1.5 and 1:3, and organic residues of the orthophosphoric acid or esters have up to 12 carbon atoms.

* * * * *